US006048196A

United States Patent [19]

Collier et al.

[11] Patent Number: 6,048,196

[45] Date of Patent: Apr. 11, 2000

[54] DURABLE SELF-GROUNDING IGNITER FOR INDUSTRIAL BURNERS

[75] Inventors: David Collier, Rockford; Scott Stroup, Rockton, both of Ill.

[73] Assignee: Eclipse Combustion, Inc., Rockford, Ill.

[21] Appl. No.: 09/395,102

[22] Filed: Sep. 13, 1999

[51] Int. Cl.[7] ..... F23Q 3/00

[52] U.S. Cl. ..... 431/264; 431/265; 313/139

[58] Field of Search ..... 431/264, 265; 313/139

[56] References Cited

U.S. PATENT DOCUMENTS

| | | | |
|---|---|---|---|
| 789,426 | 5/1905 | Herz . | |
| 790,571 | 5/1905 | Herz . | |
| 1,312,317 | 8/1919 | Gerken . | |
| 1,360,814 | 11/1920 | Storms . | |
| 1,360,956 | 11/1920 | Hughes . | |
| 1,391,691 | 9/1921 | Pohle . | |
| 2,684,060 | 7/1954 | Schechter | 123/169 |
| 2,860,695 | 11/1958 | Lake | 158/115 |
| 3,009,075 | 11/1961 | Hensley | 313/137 |
| 3,229,748 | 1/1966 | Spielman | 158/109 |
| 3,418,060 | 12/1968 | Spielman et al. | 431/158 |
| 3,706,897 | 12/1972 | Shepardson | 313/41 |
| 3,988,646 | 10/1976 | Atkins et al. | 317/96 |
| 4,062,343 | 12/1977 | Spielman | 126/91 |
| 4,626,196 | 12/1986 | Stohrer, Jr. | 431/264 |
| 4,673,350 | 6/1987 | Collier | 431/353 |
| 4,705,022 | 11/1987 | Collier | 126/91 |
| 4,963,089 | 10/1990 | Spielman | 431/351 |
| 5,103,136 | 4/1992 | Suzuki et al. | 315/59 |
| 5,241,949 | 9/1993 | Collier | 126/91 |
| 5,498,154 | 3/1996 | Velie et al. | 431/264 |
| 5,647,739 | 7/1997 | McDonald | 431/352 |
| 5,705,892 | 1/1998 | Codina et al. | 315/58 |
| 5,731,655 | 3/1998 | Corrado | 313/138 |
| 5,821,675 | 10/1998 | Suzuki | 313/123 |
| 5,839,891 | 11/1998 | Cook | 431/7 |
| 5,934,898 | 8/1999 | Fayerman | 431/353 |
| 5,984,668 | 11/1999 | Hansen et al. | 431/264 |

*Primary Examiner*—Carroll Dority
*Attorney, Agent, or Firm*—Leydig, Voit & Mayer Ltd

[57] ABSTRACT

A self-grounding igniter for an industrial burner that is more durable and less fragile, by virtue of the insulating jacket being relatively short and limited to the tip end of the igniter. The burner has a final inlet, an air inlet, a housing and a burner nozzle inside the housing. The igniter comprises a metal rod having a discharge electrode at one end and a mount and connector at the other end. The connector is adapted to be electrically coupled to a power source. An insulating jacket circumscribes a top end segment of the metal rod in proximity to the discharge electrode. A ground electrode metal sleeve is mounted to the outside of the insulating jacket in fixed proximity to the discharge electrode, thereby forming a spark gap having a fixed distance. This configuration provides an exposed metal surface on the rod between the insulating jacket and the mount. The exposed metal surface has a length substantially corresponding to the distance between the housing and the burner nozzle. The insulating jacket is also of two piece construction with two telescopically interfitting shells.

22 Claims, 3 Drawing Sheets

DURABLE SELF-GROUNDING IGNITER FOR INDUSTRIAL BURNERS

FIELD OF THE INVENTION

The present invention relates generally to igniters, and more particularly relates to igniters for use in industrial burners.

BACKGROUND OF THE INVENTION

An industrial burner typically comprises a housing having a fuel inlet, an air inlet, a burner nozzle, and a discharge outlet. The housing also usually includes a combustion sleeve that extends downstream to the discharge outlet. Air and fuel enter a burner through their respective inlets and are mixed as they pass through the burner nozzle. At the discharge outlet there is an "ignition zone" where an igniter creates a spark which ignites the fuel/air mixture. Ideally, the ignition zone is located where the air to fuel mixture is optimal. In a common arrangement in industrial burners, one or more igniters extend through the housing and nozzle, into the ignition zone. The igniters extend along the length of the burner, parallel with the typical flow of air and fuel. Due to the wide array and sizes of industrial burners, the distance between the housing and ignition zone will vary a substantial amount. This distance can approach one meter in length in some industrial burners. Not only do industrial burners vary in size and shape, but also in their application. Thus an igniter may be required to fire once every five seconds or merely once a month, depending upon the particular application. Regardless of the size, shape or application of the industrial burner, the reliability of the spark is of key importance to ensure proper ignition at the desired time.

One prior art approach has been to provide non-self-grounding igniter in which the discharge electrode of the igniter is grounded to a separate metal post. The post is typically mounted to the nozzle or housing of the burner. Unfortunately, this type of igniter structure can result in unreliable sparking. It was easy for the discharge electrode and ground electrode to be separated too great a distance to permit sparking. For example, the distance between the igniter and the post could charge during handling or possibly during repair or maintenance of the burner. With this approach, the length of the spark gap inherently depends upon the proper placement of the igniter within the burner. Even then, slight bends in the rod could make the spark gap too wide or too narrow, or even cause direct contact between ground and discharge electrode which would in turn prevent formation of spark. These small differences in distance can have a significant impact on the reliability of spark creation which can prevent ignition and therefore failure of the burner.

In an attempt to overcome this problem, a self-grounding igniter was developed where the ground electrode is provided on the igniter itself. This igniter allowed for the spark gap to be fixed within rather tight tolerances, thereby obviating the drawbacks of the earlier igniters. The ground electrode of this igniter extends along the length of the igniter, back to the housing to provide the necessary ground. In order to prevent the metal rod from prematurely discharging into the ground electrode, insulating material also extends back to the housing, in order to provide an electrical barrier protecting against premature discharge.

Despite the improvement in spark reliability, this solution of the self-grounding igniter has had problems of its own. As noted above, the ignition zone is often deep within an industrial burner, resulting in igniters that may approach a meter in length. As such, these igniters tend to be rather expensive due to the amounts of raw materials required to manufacture the igniters. More importantly, these igniters are fragile and difficult to handle. The ceramic insulation of these igniters break occasionally during installation or replacement. The high fragility and fracture rate in turn requires additional care during assembly, installation and handling, and any resulting breakage will increase the maintenance cost of industrial burners.

SUMMARY OF THE INVENTION

In light of the above, a general objective of the present invention is to provide a reliable igniter that is more durable and self-grounding.

It is another object of the present invention to accomplish the above objective while providing an igniter that is inexpensive to manufacture.

It is yet another object of the present invention to provide an igniter which can be adapted for use in certain different sizes and types of burners. Thus it is an object to provide an igniter that can be used in different burners having different configurations and locations of ignition zones within the respective burners.

In view of these and other objects of the invention, the present invention is directed towards a self-grounding igniter for an industrial burner in which the insulating jacket is relatively short and limited to the tip end of the igniter. The igniter generally includes a metal rod having a discharge electrode at one end and an electrical connector and mount at the other end, an insulating jacket and a ground electrode. The ground electrode is fixed relative to the discharge electrode to provide a fixed distance spark gap. The insulating jacket and ground electrode are located only at the tip end of the metal rod such that an exposed metal surface of the rod exists between the mount and the insulating jacket. The ground electrode is intended to be grounded locally at the tip end rather than being run all the way back to the mounting end of the igniter. This configuration has the benefits of being self-grounding with a fixed spark gap, thereby reliably producing a spark relatively independent of how it is mounted within the burner, and being highly durable in that the insulating jacket is typically short relative to the overall length of the igniter and limited to only the tip end. This also has cost advantages as the material necessary for assembling the igniter is reduced over prior self-grounding igniters.

It is a feature of the present invention to provide an insulating jacket comprised of two telescopically interfitting shells. The two shells can be provided such that a ground electrode in the form of a cylindrical sleeve can be held in place within a cylindrical recess formed between shoulders of the two shells. The shells interfit along a long contact surface that is greater than the radial thickness of the shells to prevent an electrical spark from traveling therebetween.

The present invention is also directed towards an industrial burner including a self-grounding igniter as described above, wherein only a end segment of the metal rod is surrounded by insulating material, resulting in a more durable igniter due to the reduced possibility of fracture. The igniter extends through the housing to receive electrical power and through the burner nozzle to place the spark in a desirable location in the ignition zone. The ground electrode of the igniter is grounded to the burner nozzle. The benefits of such an industrial igniter are manifold. Repair and maintenance of the burner will not be as difficult due to the reduced concern over the fragility of the igniter. Further, the spark gap is fixed, resulting in reduced concern over accidental displacement of the ground electrode. Finally, since the igniter has a fixed spark gap and is itself more durable, its replacement is much easier.

Other object and advantages of the invention will become more apparent from the following detailed description when taken in conjunction with the accompanying drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE PREFERRED EMBODIMENT

Figure 1:
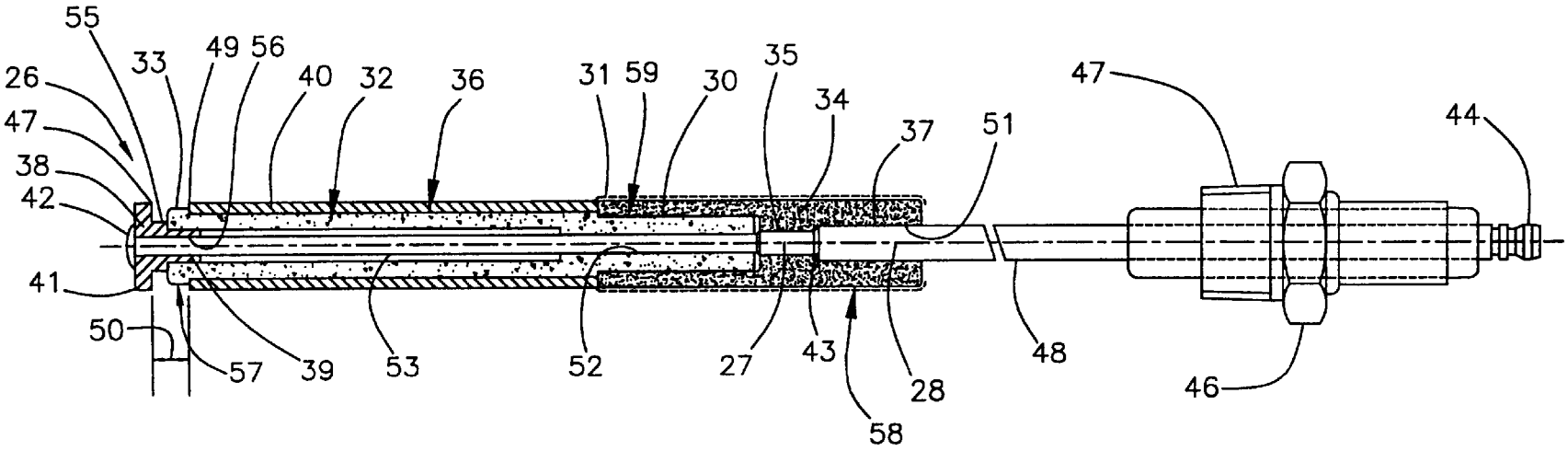
FIG. 1 is a partly fragmented cross sectional view of the igniter in accordance with a preferred embodiment the present invention.

Referring now to the drawings, FIG. 1 shows a preferred embodiment of the present invention in the form of an igniter 26. The igniter 26 generally comprises a metal rod 28, an insulating jacket 30, a discharge electrode 38, a ground electrode 40 and a mount 46. At one end, the metal rod 28 has an electrical connector 44 for connection to an electrical power source (not shown) and an insulated mount 46 for attaching the metal rod 28 to a mounting surface. At the other end, the metal rod 28 has a discharge electrode 38. In the preferred embodiment, the discharge electrode 38 is a separate component that is in the form of a disc shaped body with a central through-hole 56 such that the electrode 38 is slidably received on the rod 28 during assembly. However, it will be appreciated by those of skill in the art that the discharge electrode 38 may be in any shape, and could merely comprise the exposed end of the metal rod 28 itself. Further, the discharge electrode 38, where appropriate, may be fixed to the metal rod 28 by any means known in the art such as interlocking grooves or pressure fitting, and is accomplished in the preferred embodiment by a weld 42 as shown in FIG. 1.

In accordance with an aspect of the present invention, an insulating jacket 30 surrounds a relatively short segment or tip end of the metal rod 28. The insulating jacket 30 provides an electrical barrier, and thus is made from a typical insulating material, usually ceramic so as to withstand the intense heat of the burner. The insulating jacket 30 prevents the tip end segment of the metal rod 28 from discharging prior to reaching the discharge electrode 38. As such, the insulating jacket 30 projects along the metal rod 28 towards connector 44 beyond the ground electrode 40 to provide an electrical barrier between the metal rod 28 and the ground electrode 40. It is an advantage that the relatively short length of the insulating jacket 30 increases igniter durability, and reduces igniter breakability and manufacturing cost of the igniter.

In accordance with another aspect of the present invention, the ground electrode 40, in the form of a cylindrical metal sleeve, is mounted to a part of the outside of the insulating jacket 30 in fixed relationship to the discharge electrode 38 to provide a self-grounding igniter. The distance between the discharge electrode 38 and the ground electrode 40 provides the spark gap 50, where the sparks which ignite the surrounding gas are formed. Reliability of the spark is very important, and even minute changes in the spark gap distance can cause severe problems with spark creation. It is an advantage that fixing the distance of the spark gap 50 ensures spark reliability. Therefore, how the igniter is mounted is not as significant in terms of spark reliability.

The mount 46 permits the end of the igniter 26 to be held in place within a burner. The mount 46 has an insulated sleeve on its interior and metal fitting over the insulation sleeve to facilitate mounting of the igniter. In the preferred embodiment, threads 47 on the metal fitting serve to mount the igniter to the burner. As a result of the relatively short length of the insulating jacket 30, the metal rod 28 has an exposed metal surface 48 that extends from the insulating jacket 30 to the mount 46 and connector 44. The mount 46 may be placed anywhere along the exposed metal surface 48 depending upon the application.

In the preferred embodiment, the ground electrode 40 in the form of a metal sleeve is secured in a cylindrical recess 36 on the insulating jacket 30 to facilitate easy assembly, wherein the insulating jacket 30 is comprised of a two interfitting shells 32, 34. For purposes of illustration, the shells 32, 34 are illustrated in FIG. 1 with different cross-sectional filling but it will be understood that the shells are intended to be of the same insulating material. The two shells 32, 34 telescopically interfit such that a cylindrical recess 36 is formed on the outer surface of the jacket 30. Each shell 32, 34 has outward projecting shoulders 31, 33 at the ends of the recess 36 which secure the metal sleeve or ground electrode 40 in the recess 36. The first shoulder 33 is also smaller in outer diameter than the outer diameter of the ground electrode 40 to prevent any spark obstructions between the ground and discharge electrodes 38, 40.

The insulating jacket 30 is secured on the metal rod 28 between the discharge electrode 38 and a seat 43 provided on the metal rod 28 between larger and smaller diameter segments 35, 37. The second insulating shell 34 has a corresponding seating surface 45 which contacts and mates with the seat 43 such that the insulating jacket 30 is sandwiched therebetween. A spot weld 42 on the end on metal rod 28 secures the electrodes and insulating jacket on the metal rod 28 and maintains tight engagement between the discharge electrode 38, the two shells 32, 34 and seat 43 of the metal rod 28 to ensure the proper distance between the discharge and grounded electrodes 38, 40. It should be noted that the insulating shells 32,34 have inner bores 51, 52 closely dimensioned to the outer diameter of the rod 28 which serves retention and locating purposes during assembly. The first shell 32 also includes a larger diameter bore 53 which provides a cylindrical gap 54 that closely receives a cylindrical stem portion 39 of the discharge electrode 38. A larger diameter intermediate portion 55 of the discharge electrode 28 urges the insulating jacket 30 against the seat 43. The discharge electrode 55 also has a through hole 56 closely dimensioned to that of the outer diameter of the rod 28 which serves locating and radial retention functions.

It is a feature that the preferred embodiment provides two end barriers 57, 58, one by each shell 32, 34, and one internal barrier 59 between shells 32, 34. The first end barrier 57 comprises the external surface of the first shell 32 which provides a barrier between intermediate portion 55 and ground electrode 40 that is long enough to prevent premature electrical discharge therebetween, thereby ensuring electrical discharge between disc portion 41 and ground electrode 40. Similarly, the second end barrier 58 comprises the external surface of the second shell 34 to prevent premature electrical discharge between the rod 28 at the ground electrode 40. The second barrier 58 is also long enough to prevent premature discharge between the burner nozzle of the intended industrial burner and the rod 28, which can be had with references to FIGS. 2 and 3. The internal barrier 59 is formed between interfitting telescopic portions of the shells 32, 34 and comprises insulating contact surfaces which inhibit electrical discharge therebetween. The telescopic portions facilitate ease in assembly while ensuring that electrical spark does not transfer there between. In particular the internal barrier 59 runs a distance greater than the distance of the spark gap 50 such that insulating sealant between shells is not necessary.

Another feature of the present invention is that a hot spark is formed on the igniter due to sharp corners 47, 49 formed on the disc portion of the discharge electrode 38 and the edge of the metal sleeve or ground electrode 40. A hot spark increases the likelihood of ignition. Moreover, the corners 47, 49 are circular and spaced at substantially equivalent distances meaning that the spark may randomly travel around the igniter 26 to better ensure eventual sparking at a location corresponding with the optimum fuel-to-air mixture.

Figure 2:
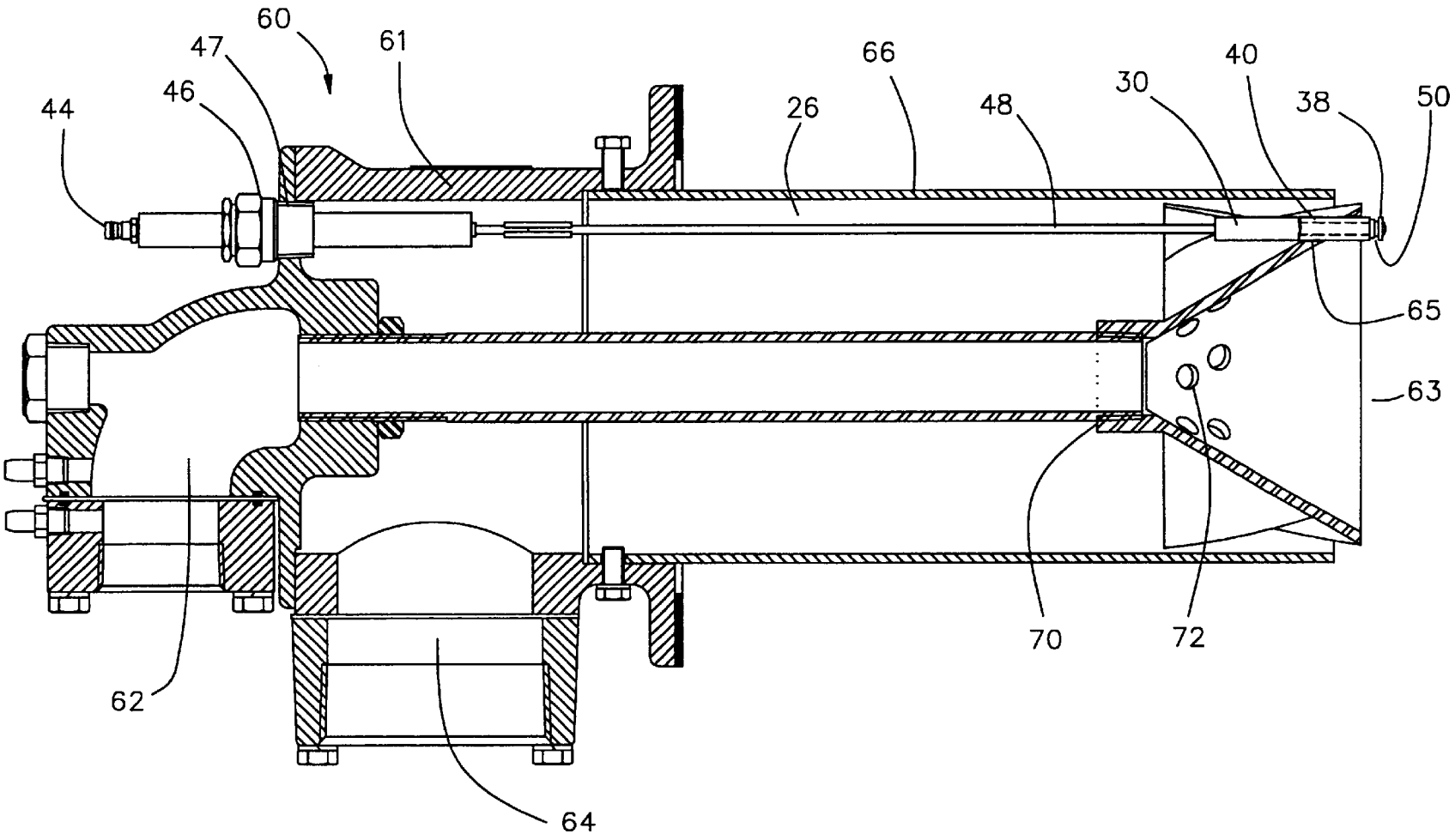
FIG. 2 is a cross sectional view of an industrial burner incorporating the igniter illustrated in FIG. 1.
Figure 3:
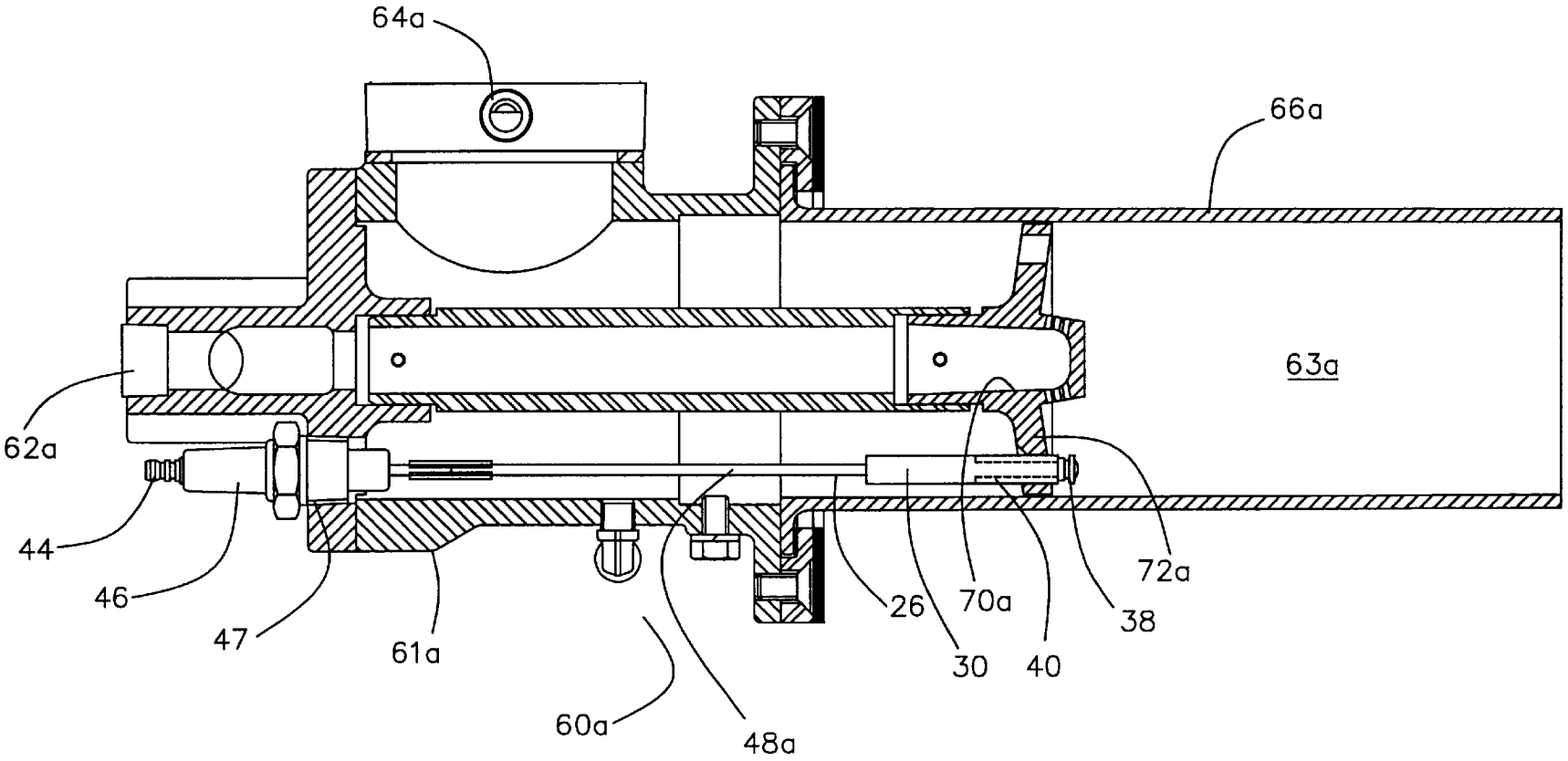
FIG. 3 is a cross sectional view of a different type of industrial burner incorporating the igniter illustrated in FIG. 1.

FIGS. 2 and 3 show industrial burners incorporating the igniter 26 in accordance with a preferred embodiment of the present invention. Referring now to FIG. 2, the burner 60 comprises a housing 61 and a nozzle 70 inside the housing 61. The housing 61 has a fuel inlet 62, an air inlet 64, and a discharge outlet 63. In this embodiment the housing 61 includes a combustion sleeve 66 that forms the discharge outlet 63 proximate the nozzle 70. Fuel and air enter along separate paths through inlets 62 and 64, respectively, and are mixed by the nozzle 70 and ignited by the igniter 26 to provide a flame. It should be noted that the spark gap 50 is located in an optimum fuel to air ratio zone facilitated by the nozzle 70 and just downstream of the nozzle 70 to ensure reliable ignition. Once ignited, the flame maintains itself and therefore, there is no need for additional ignition by the igniter 26.

The igniter 26 is horizontally mounted within the burner 60 such that it extends through the housing 61 into the combustion sleeve 66. One end of the igniter 26 is held in place by mount 46, which is fastened into the housing 61 by threads 47. The exposed metal surface 48 extends through the burner 60, having a length substantially corresponding to the distance between the housing 61 and the nozzle 70. The other end of the igniter 26 is supported by the nozzle 70 at a point corresponding with the ground electrode 40. The ground electrode 40 is sufficiently long enough such that it is in electrical communication with the nozzle 70 no matter how much the igniter 26 is tightened or whether thermal expansion or contraction may affect the nozzle contact point. To ensure electrical grounding between the nozzle 70 and the ground electrode 40, a igniter hole 65 is closely machined into the nozzle 70 to have a tight tolerance with the outer diameter of the metal electrode 40. The weight of the igniter 26 will typically cause the ground electrode 40 to rest directly in electrical contact with the burner nozzle 70 or otherwise be in electrical communication therewith.

FIG. 3 shows the present invention in conjunction with another industrial burner operative from both an operating and ignition standpoint as that shown in FIG. 2. The burner 60*a* contains a housing 61*a* and a nozzle 70*a* inside the housing 61*a*. The housing has a fuel inlet 62*a*, an air inlet 64*a* which typically receives air from a far and a discharge outlet 63*a*. In the preferred embodiment, the housing 61*a* also includes a combustion sleeve 66*a* that forms the discharge outlet 63*a* proximate the nozzle 70*a*.

The burner 60*a* also utilizes an igniter 26. The igniter 26 is horizontally mounted within the burner 60*a* such that it extends through the housing 61*a* into the combustion sleeve 66*a*. One end of the igniter 26 is held in place by mount 46, which is inserted into the housing 61*a*, typically by threads 47, although other fitting means are contemplated by the present invention. The exposed metal surface 48 extends through the burner 60*a*, having a length substantially corresponding to the distance between the housing 61*a* and the downstream end of the nozzle 70*a*. The other end of the igniter 26 is supported by the nozzle 70 at a point corresponding with the ground electrode 40. The ground electrode 40 is in electrical communication with the nozzle 70*a*, which is in turn grounded to the housing 61*a*.

In practice, various industrial burners have differing lengths between the housing and the ignition area within the burner. Thus the appropriate points to support igniters also vary, as do the distances between those points. A practical advantage of the present invention is that the length of the igniter 26 can be easily changed depending upon any particular burner. The length of the exposed metal surface 48 of the metal rod 28 may be varied by cutting the end of the metal rod 28 corresponding with the connector 44 and adapter 46. Once the requisite distance is calculated and the metal rod 28 is cut accordingly, a mount 46 and a connector 44 can then be easily fit onto the metal rod 28 or otherwise connected thereto. Thus in practice, the length of the exposed metal surface 48 of the metal rod 28 can vary, from as short as 25 millimeters to as long 1 meter, although the present invention could also potentially be used for shorter or longer lengths depending upon the application. The present invention is particularly advantageous for igniters having longer lengths. Further, a ground electrode 40 may be provided such that tight tolerances need not be kept in the cutting of the metal rod 28 to ensure electrical coupling to the nozzle. Therefore, having an exposed metal surface on the metal rod not only increases the durability of the igniter, but also permits modification of its length depending upon the application. Thus a stock of only one igniter need be kept for a wide range of industrial burners.

What is claimed is:

1. An igniter comprising:

a metal rod having a discharge electrode at one end and a mount and electrical connector at the other end for electrical connection to an electrical ignition source;

an insulating jacket circumscribing a segment of the metal rod in proximity to the discharge electrode;

a ground electrode mounted to the outside of the insulating jacket in fixed proximity to the discharge electrode, thereby forming a spark gap between the ground and discharge electrodes; and an exposed metal surface on the metal rod extending between the insulating jacket and the mount.

2. An igniter as in claim 1, wherein the length of the exposed metal surface of the metal rod is greater than the length of the insulating jacket.

3. An igniter as in claim 1, wherein the exposed metal surface of the metal rod has a length between about 25 millimeters and about 1 meter, and wherein the insulating jacket has a length between 20 millimeters and 250 millimeters.

4. An igniter as in claim 1, wherein the insulating jacket has an exposed surface between the ground electrode and the discharge electrode, thereby providing an electrical barrier, the barrier being sufficiently long to ensure that the spark gap is between an outer radial edge of the discharge electrode and the ground electrode.

5. An igniter as in claim 1, wherein the insulating jacket is comprised of a first and second telescopically interfitting shells, the first shell being closer to the discharge electrode than the second shell, the first and second shells mating along an internal electrical barrier having a length greater than the spark gap and greater that the radial thickness of the first and second shells.

6. An igniter as in claim 1, wherein the insulating jacket has an exposed surface between the discharge electrode and the ground electrode and the exposed surface providing an electrical barrier therebetween, the barrier being sufficiently long to ensure that the spark gap is between the discharge electrode and the ground electrode.

7. An igniter as in claim 1, wherein the insulating jacket comprises two interfitting shells providing a cylindrical recess therebetween, the ground electrode being a cylindrical metal sleeve mounted within the recess.

8. An igniter for an intended industrial burner, the burner having a housing and a burner nozzle inside the housing, the igniter comprising:

a metal rod having a discharge electrode at one end and a mount and electrical connector at the other end, the mount adapted to mount into the housing for support with the electrical connector on the outside of the housing;

an insulating jacket circumscribing a segment of the metal rod in proximity to the discharge electrode;

a ground electrode mounted to the outside of the insulating jacket in fixed proximity to the discharge electrode, thereby forming a spark gap between the ground and discharge electrodes, the ground electrode adapted to be grounded to the nozzle when the igniter is mounted to the housing as intended; and an exposed metal surface on the metal rod extending between the insulating jacket and the mount, the exposed metal surface having a length substantially corresponding to a distance between the housing and the burner nozzle of the intended burner.

9. An igniter as in claim 8, wherein the length of the exposed metal surface of the metal rod is greater than the length of the insulating jacket.

10. An igniter as in claim 8, wherein the exposed metal surface of the metal rod has a length between 25 millimeters and 1 meter, and wherein the insulating jacket has a length between 20 millimeters and 250 millimeters.

11. An igniter as in claim 8, wherein the insulating jacket has an exposed surface between the ground electrode and the discharge electrode, thereby providing an electrical barrier, the barrier being sufficiently long to ensure that the spark gap is between an outer radial edge of the discharge electrode and the ground electrode.

12. An igniter as in claim 8, wherein the insulating jacket is comprised of a first and second telescopically interfitting shells, the first shell being closer to the discharge electrode than the second shell, the first and second shells mating along an internal electrical barrier having a length greater than the spark gap and greater that the radial thickness of the first and second shells.

13. An igniter as in claim 8, wherein the insulating jacket has an exposed surface between the ground electrode and the exposed metal surface thereby providing an electrical barrier, the barrier being sufficiently long to ensure that the spark gap is between the discharge electrode and the ground electrode.

14. An igniter as in claim 8, wherein insulating jacket comprises two interfitting shells providing a cylindrical recess therebetween the ground electrode being a cylindrical metal sleeve mounted within the recess.

15. An igniter, comprising:

a metal rod having larger and smaller diameter segments with a seating surface therebetween;

an insulating mount secured to the larger diameter segment of the metal rod, the mount including threads;

an electrical connector on the end of the larger segment;

a discharge electrode slidably fitted on the smaller diameter segment and secured on the metal rod;

two interfitting insulating shells slidably fitted on the smaller diameter segment sandwiched securely between the discharge electrode and the seating surface, the insulating shells being separated from the mount on the metal rod, the interfitting shells providing a cylindrical recess; and a cylindrical metal sleeve secured in the cylindrical recess to provide a ground electrode separated from the discharge electrode by a spark gap.

16. The igniter of claim 15 further comprising three electrical barriers provided by the insulating shells, each barrier having a length greater than the length of the spark gap, the first barrier being between the ground electrode and an inner radial portion of the discharge electrode to ensure the spark gap is between an outer radial portion of the discharge electrode and the ground electrode, the second barrier being internal between mating surfaces of the two shells, the third barrier being between the larger diameter segment and the ground electrode.

17. The igniter of claim 15 wherein the discharge electrode includes a stem portion engaging one of the insulating shells and a disc portion extending radially outward therefrom, the spark gap being formed between a circular corner of the disc portion and the circular edge of the metal sleeve.

18. A burner for producing an air and fuel mixture and combusting the mixture down an immersion tube, the burner comprising:

a housing having a fuel inlet, an air inlet, a discharge outlet;

a burner nozzle mounted inside the housing between the inlets and the discharge outlet, the nozzle adapted to mix and convey air and fuel in the housing and downstream towards the discharge outlet; and an igniter extending through the housing and burner nozzle into the discharge outlet, the igniter comprising a metal rod, an insulating jacket, and a ground electrode, the metal rod having a discharge electrode at one end and a mount and an electrical connector at the other end, the mount securing the igniter to the housing with the electrical connector located outside of the housing, the insulating jacket circumscribing a segment of the metal rod in proximity to the discharge electrode, the ground electrode mounted to the outside of the insulating jacket in fixed proximity to the discharge electrode thereby forming a spark gap between the discharge and ground electrodes, the ground electrode extending through the nozzle in electrical communication with the nozzle for grounding thereby, the igniter further comprising an exposed metal surface of the metal rod extending between the insulating jacket and the mount.

19. The burner of claim 18 wherein the exposed metal surface has a length substantially corresponding to a distance between the outer housing and the burner nozzle.

20. The burner of claim 18 wherein the ground electrode comprises a tubular metal sleeve surrounding the insulating jacket and the nozzle includes a closely machined igniter hole receiving the metal sleeve therethrough, the hole being toleranced tightly with the outer diameter of the sleeve sufficiently to ensure electrical communication therebetween.

21. The burner of claim 20 wherein the igniter extends horizontally and rests on the nozzle with the metal sleeve in electrical contact therewith.

22. The burner of claim 18 wherein the insulating jacket includes a portion extending sufficiently between the ground electrode and the exposed metal surface to provide an electrical barrier that prevents premature spark discharge between the rod and the burner nozzle and the rod and the ground electrode, the ground electrode being sufficiently long enough to ensure grounding electrical communication between the nozzle and the ground electrode over all operating conditions of the burner.

* * * * *